United States Patent [19]

Becker et al.

[11] Patent Number: 4,498,192

[45] Date of Patent: Feb. 5, 1985

[54] BAG HAVING AN OVERLAPPED CLOSURE AND METHOD OF FABRICATING THE SAME

[75] Inventors: Arnold F. Becker, Solingen, Fed. Rep. of Germany; Harold K. Johnson, Junction City, Kans.

[73] Assignee: Mid America Machine Corp., Junction City, Kans.

[21] Appl. No.: 462,026

[22] Filed: Jan. 28, 1983

[51] Int. Cl.[3] ..... B65D 33/24

[52] U.S. Cl. ..... 383/126; 383/114; 383/123; 493/213; 493/232; 493/235; 493/929

[58] Field of Search ..... 383/123, 121, 122, 124, 383/125, 126, 53, 54, 111, 114; 493/232, 231, 237, 255, 257, 258, 259, 235, 236, 227, 213, 929

[56] References Cited

U.S. PATENT DOCUMENTS

| | | | |
|---|---|---|---|
| 904,168 | 11/1908 | Widmer | 383/124 |
| 1,213,769 | 1/1917 | Jacobs | 493/231 |
| 1,950,232 | 3/1934 | Edgerly | 383/114 |
| 2,013,672 | 9/1935 | Royal | 383/123 X |
| 2,275,505 | 3/1942 | Crawford et al. | 383/54 |
| 3,277,798 | 10/1966 | Krauss | 493/232 |
| 3,479,802 | 11/1969 | Fesco | 493/213 X |
| 3,526,354 | 9/1970 | Gibbs | 383/123 |
| 3,807,626 | 4/1974 | Goodrich | 383/111 X |
| 3,910,488 | 10/1975 | Goodrich | 383/111 X |
| 3,927,825 | 12/1975 | Stearley | 383/114 |
| 4,142,667 | 3/1979 | Runo | 383/114 X |

*Primary Examiner*—Allan N. Shoap
*Assistant Examiner*—Bryon Gehman
*Attorney, Agent, or Firm*—Schmidt, Johnson, Hovey & Williams

[57] ABSTRACT

An improved bag construction, and a method of bag forming, are disclosed which gives an economical yet strong, burst- and leak-resistant closure without the necessity of sewing or use of expensive stepped cut tubes. The bag is formed using a tube having opposed, interconnected front and rear panels, wherein a pair of laterally spaced, parallel cut lines are provided adjacent the top margin of the tube which define opposed first and second marginal flaps respectively in the front and rear panels. In bag-forming operations, the first flap is folded and glued against the outer face of the front panel, and the closure is completed by folding and gluing the second flap over the open end of the tube in a manner to refold the first flap and engage the outer face of the first panel. In another embodiment, a filling valve is inserted between the front and rear panels adjacent the closure end during the bag-forming operation, so as to provide a valve bag. The closure construction evenly distributes potentially distructive impact forces over a relatively large portion of the bag panels, to thus materially increase bag strength at the critical closure areas.

14 Claims, 17 Drawing Figures

Fig. 1
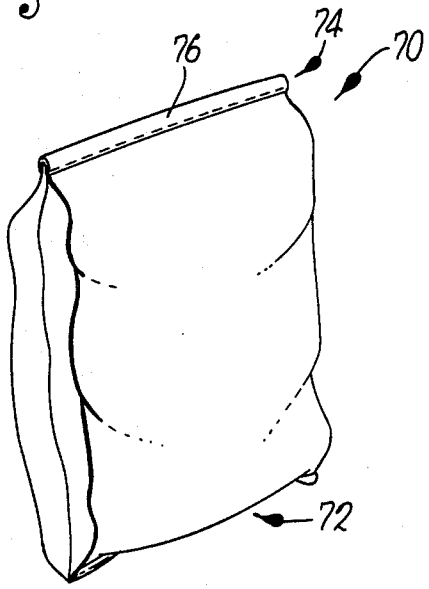
Fig. 2
Prior Art
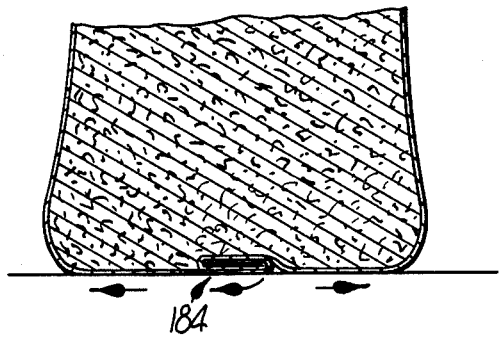
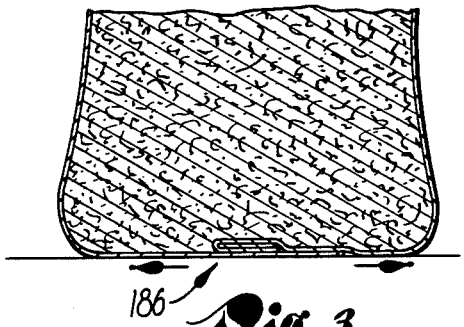
Fig. 3
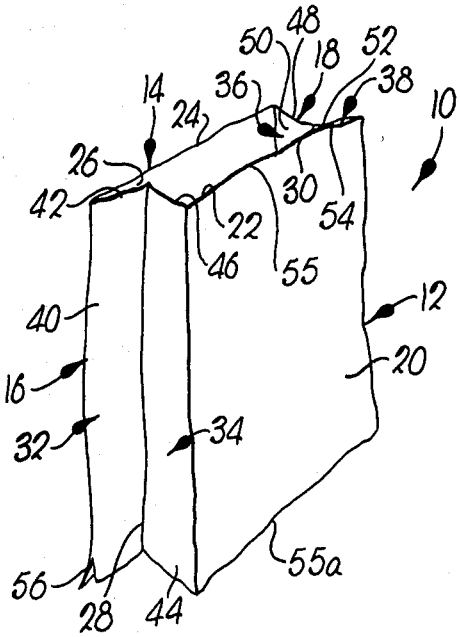
Fig. 4
Fig. 5
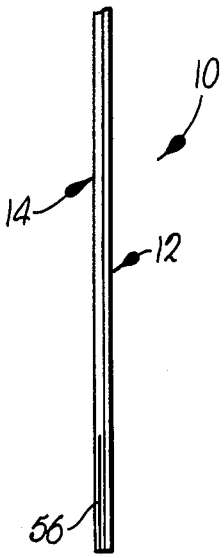

Fig. 11
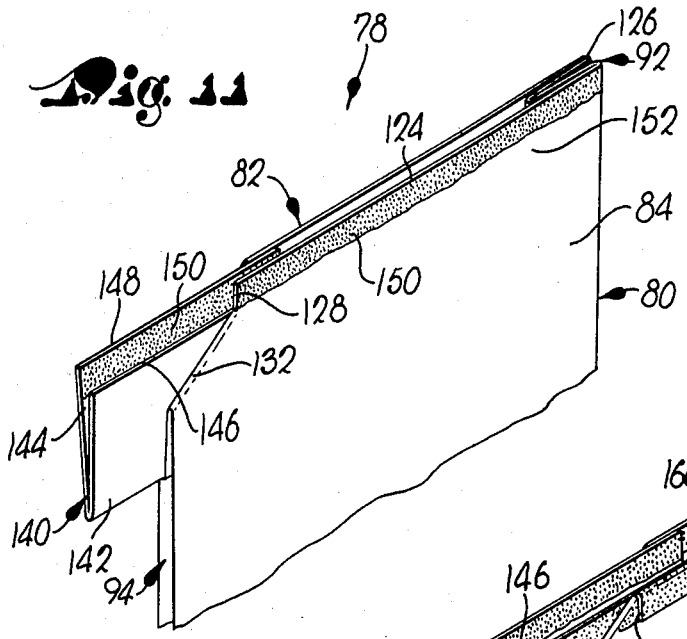
Fig. 12
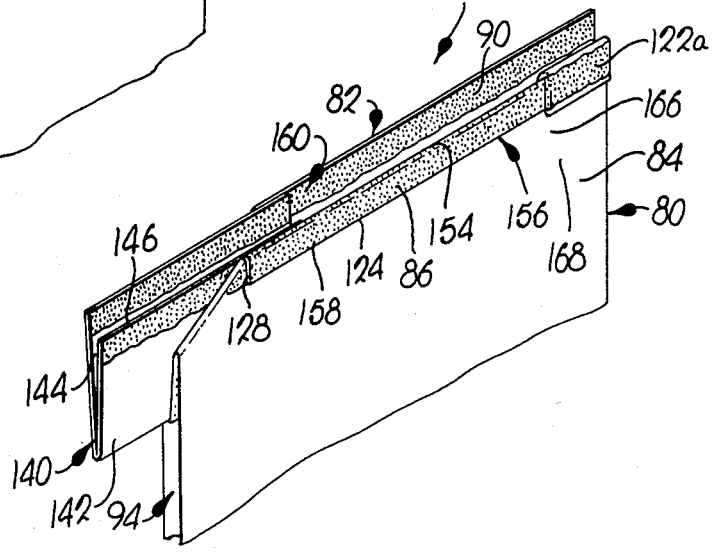
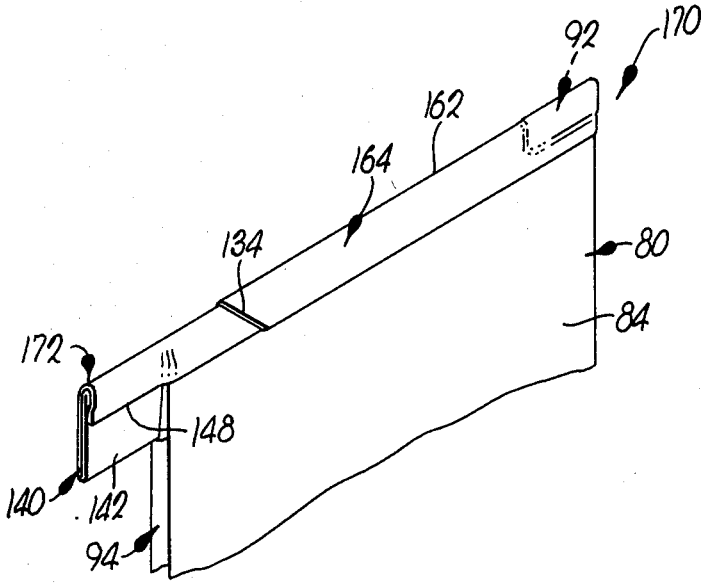
Fig. 13

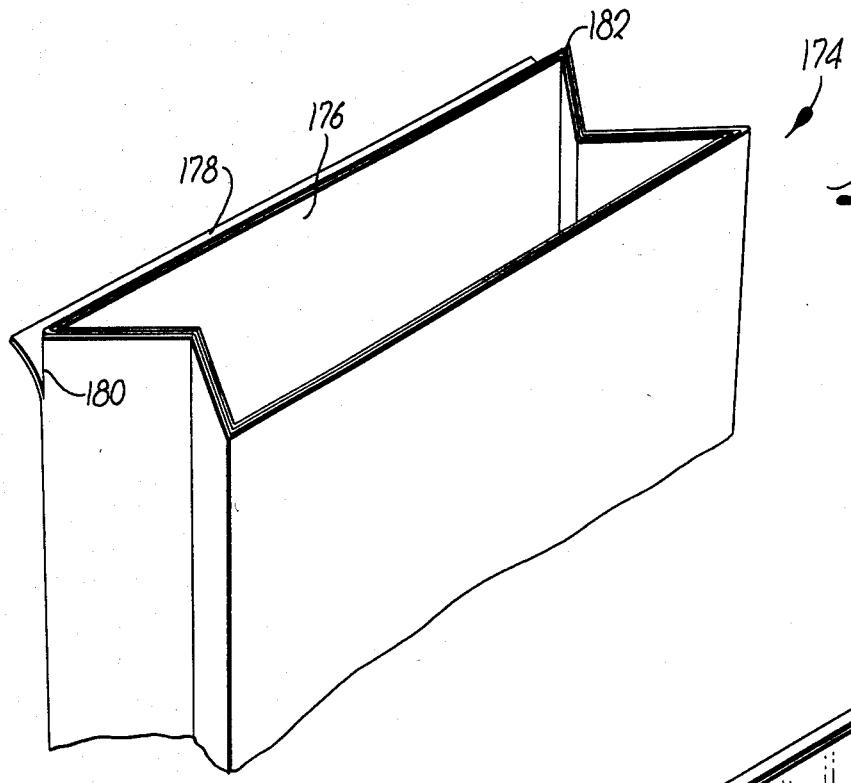
Fig. 14
Fig. 15
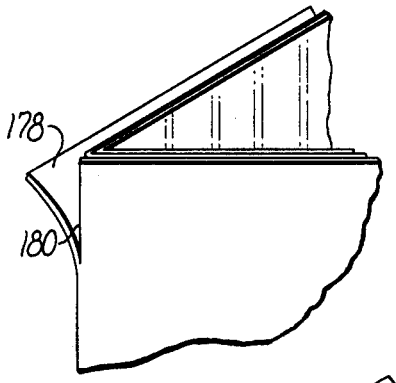
Fig. 16
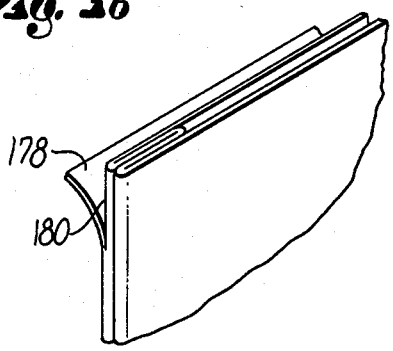
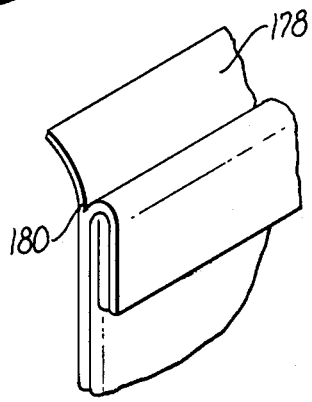
Fig. 17

BAG HAVING AN OVERLAPPED CLOSURE AND METHOD OF FABRICATING THE SAME

BACKGROUND OF THE INVENTION

1. Field of the Invention

This invention relates to a bag having a unique closure of simple, yet highly effective, construction which has numerous advantages including: use of a cost-saving flush cut tube as opposed to expensive stepped cut tubes, high strength at the region of closure, prevention of sifting, ability to be butt printed, the capability to be valved without extensive modification, and the ability to accommodate a plastic inner liner. More particularly, it is concerned with a bag having a closure in which preferably one panel and the adjoining sides are double folded and the other panel is lapped over the double fold and adhesively secured, thus providing a stronger seam and sift proof corners. Additionally, a valve may be inserted between the tube panels prior to folding which allows field packing and emptying. Further, plastic inner liner may be easily incorporated providing a moisture barrier for the contents of the bag.

2. Description of the Prior Art

In the packaging industry many types of bag closures are used, but two main types have gained widespread acceptance. However, as will be seen, each of these two types of bags have associated problems. The first type, the sewn bag, is simply a closure where tape is placed over the end of the bag and the tape and the bag are transversely sewn. The sewn closure has significant shortcomings, not only in the expense of the sewing operation, but more importantly, lateral forces imposed on the closure tend to concentrate along the sewn seam. The concentration of lateral stress forces along a transverse line often results in burst seams, as for example when a bag is dropped. The sewn closure is also difficult and expensive to valve.

The second type of bag, the pinched bottom closure, is stronger than the sewn closure, but is deficient in a number of other respects. A particular problem with the pinched type closure is that it must be made using stepped end tubes which are ore expensive to manufacture than flush cut tubes. Additionally, the top and bottom of the bag require a great deal of solid spot pasting, especially in a multiwall type container. Although a pinch bottom bag may be valved, it is a process involving a large amount of spot pasting, thus increasing the cost.

A number of bags with folded closures have been proposed in the past. In general, however, these closures have not met the needs of the packaging industry, because of their additional expense in manufacture or insufficient strength of the closure. Patents illustrating these prior closures includes U.S. Pat. Nos. 3,526,354, 2,429,505, 3,910,488, and 3,927,825.

SUMMARY OF THE INVENTION

The problems outlined above are in large measure solved by the bag and closure in accordance with the invention. That is to say, the bag hereof is more sift proof, stronger, has the ability to be butt printed, can be manufactured using flush cut tubes, need not be sewn, and requires only a moderate amount of spot pasting. Additionally, the bag in accordance with the invention can incorporate a valve or a plastic inner liner without substantial modification.

The bag in accordance with the present invention broadly includes a pair of facially opposed panels interconnected by side margin closures, and a double fold split flap end closure of at least one end of the bag. Preferably, the end closure includes a first, elongated, marginal, transversely extending flap formed from at least a part of the front panel adjacent the closure end which is first folded over upon the first panel such that the outer face of the first flap engages the outer face of the first panel at a first transverse region adjacent the first flap. A second, elongated, marginal, transversely extending, flap, formed using at least a part of the back panel, is next concurrently folded with the first flap such that the inner face of the first flag engages the outer face of the first panel at a second region adjacent the first region, and the second flap engages the outer face of the first panel at a third region adjacent the second region. As can be appreciated, the panels are normally adhesively bonded at each stage of folding, thus establishing a very secure closure.

In particularly preferred forms, the bag is formed using an integral, multiwall tubular container in which the plies of the sheet material are adhesively bonded together along a portion of the end to be closed. Additionally, the front and back panels are interconnected by a pair of gusseted side panels, and the first flap is formed by making short cuts (e.g., no more than about one inch in length in the end of the bag adjacent each side thereof, where the side panels adjoin the back panel. By incorporating gusseted side panels and first cutting and folding the tube as described, the corners of the closure after folding are thereby strengthened and become more sift-proof.

One particular advantage of the bag lies in the ease in which a filling valve can be installed. In this embodiment, the side panel adjacent the closure end is first folded inwardly to present a valve-receiving passageway. An elongated valving sleeve is positioned within the passageway and adhesively secured to the passageway-defining walls. The valve serves to communicate the interior of the bag with the atmosphere and allows field packing.

As may be appreciated, many variations of the bag in accordance with the invention exist. For example, in a third embodiment, a starting tube having multiple-ply front and rear panels is employed, and the flap-forming cuts are made between adjacent plies of the rear panel. Thus, the first flap includes the marginal portion of the front panel, the side panels, and a number of plies of the back panel,; and the second flap is formed of corresponding marginal portions of the remaining plies of the back panel. This embodiment is particularly useful when the innermost ply of the container comprises a synthetic resin material. In this manner, the synthetic resin material need not form a part of any adhesive securement, but rather both the first and second flaps are adhesively secured paper-to-paper to the outer face of the front panel. This embodiment thus uses plies more suited to conventional adhesive bonding, and yet the innermost ply of synthetic resin material provides a desirable moisture barrier in the completed bag.

BRIEF DESCRIPTION OF THE DRAWINGS

FIG. 1 is a perspective view of a bag in which the top of the bag is closed by the prior art sewing method, and the bottom of the bag illustrates the closure in accordance with the present invention;

FIG. 2 is a vertical sectional view of a prior art double fold closure bag in which the arrows depict the concentrated stress lines along the small area of the bag closure when the bag is dropped;

FIG. 3 is a vertical sectional view of a bag in accordance with the present invention in which the arrows depict the evenly distributed stress lines over a large area adjacent the closure when the bag is dropped;

FIG. 4 is a perspective view of a container tube with gusseted side panels and which illustrates one of the marginal cuts made between the gusseted side panels and the rear tube panel adjacent the end to be closed;

FIG. 5 is a side elevational view of the tube depicted in FIG. 4 and further illustrating the cuts on sides of the tube;

FIG. 11 is a perspective view in which a valving sleeve is inserted in the valving fold and glue is applied along a portion thereof;

FIG. 12 is a perspective view and illustrates the first fold where the outer face of the first flap engages the outer face of the front panel;

FIG. 13 is a perspective view of a completed valve bag in accordance with the invention wherein the inner face of the first flap engages the outer face of the front panel, and the second flap is folded over the first flap and engages the outer face of the front panel;

FIG. 14 is a perspective view of a third embodiment of the invention wherein a multiwall container is provided and the cuts are made between the plies of the rear panel adjacent the end to be closed;

FIG. 15 is an enlarged perspective view of a corner of the bag shown in FIG. 14;

FIG. 16 is an enlarged perspective view of a portion of the bag shown in FIG. 14 wherein the bag is flattened prior to folding and showing particularly that the first flap incorporates several plies of the rear panel, and the second flap includes the remaining plies of the rear panel; and FIG. 17 is an enlarged perspective view of the embodiment of FIGS. 14–16, showing the outer face of the first flap engaging the outer face of the front panel.

DESCRIPTION OF THE PREFERRED EMBODIMENTS

Figure 6:
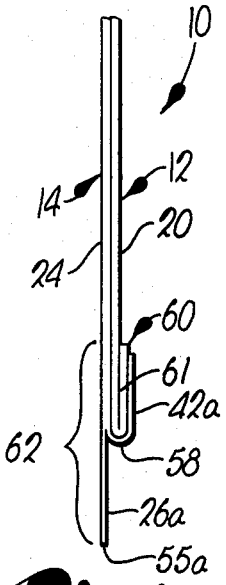
FIG. 6 is a side elevational view of the first closure flap folded over and secured to the outer face of the front panel of the tube.

Turning now to the drawings, and particularly FIG. 4, a bag-forming tubular container 10 is illustrated. Broadly speaking, the container 10 includes a pair of elongated, substantially rectangular front and rear panels 12, 14, as well as respective side gusseted panels 16, 18, serving to interconnect panels 12, 14, and present the overall tubular configuration of container 10.

In more detail, the respective panels 12–18 of container 10 are preferably formed from multiple ply flexible paper material in which the plies are adhesively secured together adjacent said panel terminal ends. In addition, it will be seen that the front panel 12 presents an outer face 20 and an opposed inner face 22; likewise, rear panel 14 presents an outer face 24 and opposed inner face 26. The gusseted side panels 16, 18, each include an elongated, central crease or fold line 28, 30, as well as a pair of diverging sub-panels 32, 34 and 36, 38. Here again, the respective sub-panels each present opposed inner and outer faces, namely outer face 40 and inner face 42 on sub-panel 32; outer and inner faces 44, 46 on sub-panel 34; outer and inner faces 48, 50 on sub-panel 36; and outer and inner faces 52, 54 on sub-panel 38. Finally, it will be observed that the gusseted side panels 16, 18 are secured to the corresponding front and rear panels 12, 14, along the outermost margins of the respective sub-panels 32, 34 and 36, 38. The container 10 is preferably of flush cut configuration, and presents respective continuous terminal edges 55 and 55*a* at the upper and lower ends thereof.

Referring specifically to FIGS. 4 and 5, it will be seen that container 10 in accordance with the invention is provided with a pair of relatively short cut lines 56 (e.g., about one inch in length). These cut lines are provided along the outer margin of respective sub-panels 40, 48 where the latter are secured to rear panel 14. Only one of the cuts 56 is illustrated in FIG. 4. In any event, the cuts 56 are important for purposes of providing a closure for container 10 in accordance with the invention.

Referring now to FIGS. 6–9, the closure sequence for container tube 10 is illustrated. Specifically, the first step involves separating the lower margin of rear panel 14 between the laterally spaced cuts 56 from the remainder of the tube construction. It will be observed that the cuts 56 serve to separate the lowermost marginal portion of back panel 14 from the forward portion of the container as illustrated in FIG. 4, i.e., the lower margins of the gusseted side panels 16, 18, and front panel 12. This last mentioned portion of the container 10 is first folded so that the lower marginal portion of outer face 20 is placed in engagement with itself. That is to say, the interconnected panels 12, 16 and 18 are grasped and folded forwardly and upwardly as viewed in FIG. 4 until these panels assume the configuration illustrated in FIG. 6. In this orientation, an elongated, transversely extending crease line 58 is formed (see FIGS. 6 and 8). This also serves to define a first flap 60 adjacent the lower end of the container. The flap 60 is bounded by the lower terminal edge 55*a*, fold line 58, and the side margins of the gussetted side panels 16, 18 adjacent rear panel 14. It will further be observed that, at the lateral ends of the flap 60, the folded over innerface portions 42*a*, 50*a* of innerfaces 42, 50 of the sub-panels 32, 36 are revealed, along with the corresponding portion 22*a* of inner face 22 of panel 12. In practice, this first flap 60 is secured to outer face 20 of panel 12 by any conventional glue or adhesive. It will further be seen that this securement is along a region 61 of face 20 directly above crease line 58.

Figure 7:
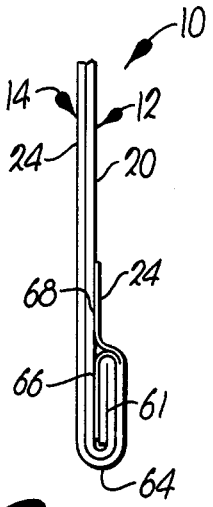
FIG. 7 is a side elevational view depicting the second fold of the first flap wherein the original inner face of the first flap engages the outer face of the front panel, and also showing the second flap folded over the first flap and engaging the outer face of the first panel.
Figure 8:
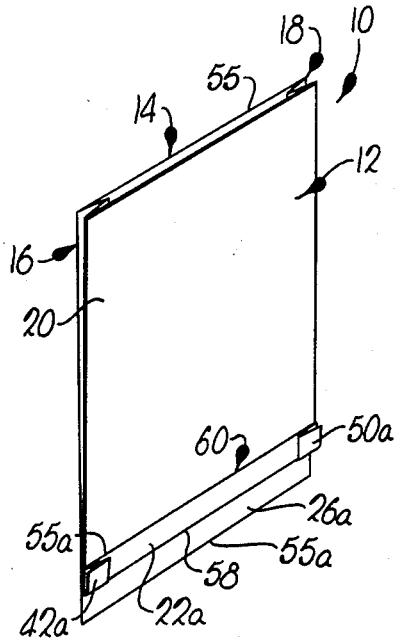
FIG. 8 is a perspective view illustrating the structure depicted in FIG. 6, and showing the first flap folded upon the front panel so that the outer face of the first flap engages the outer face of the front panel.
Figure 9:
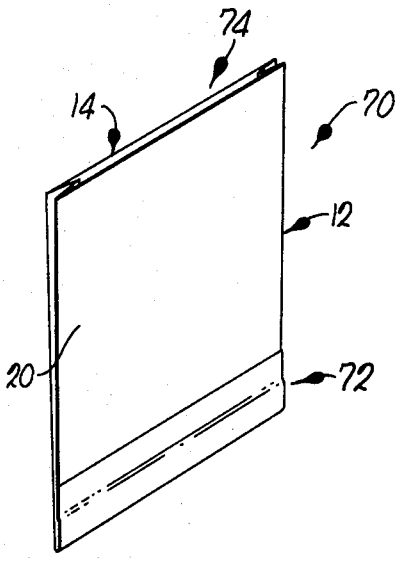
FIG. 9 is a perspective view illustrating the structure depicted in FIG. 7, and showing a bag with gusseted side panels in which the first flap is folded so that the inner face of the first flap engages the outer face of the first panel and the second flap folds over the first flap and engages the outer face of the first panel.

Closure of the lowermost end of container 10 is completed by grasping the remaining portion of rear panel 14 and folding a marginal section thereof upwardly as viewed in FIG. 6 to assume the FIG. 7 configuration. Specifically, this marginal section is bracketed in FIG. 6 and referred to by the reference numeral 62. Generally speaking, prior to this folding operation an adhesive is applied to the exposed face 22*a*, the exposed portions of the gusseted sub-panels 42*a*, 50*a*, and the lower marginal portion 26*a* of inner face 26 of panel 14 (see FIG. 8). In any event, this folding operation creates a second, elongated, transversely extending crease line 64 which in effect forms the bottom or closure end of the completed bag as will be described. Further, this folding operation, as will be observed from a study of FIGS. 6 and 7, serves to refold the flap 60 along a transverse line substantially coincident with the uppermost margin 55*a* thereof so that the portion 22*a* engages and is adhesively secured to face 20 at a region 66 above region 61. The portion of inner face 26*a*, on the other hand, directly engages and is adhesively secured to the face 20 at a region 68 directly above region 66. This completed construction gives a bag 70 illustrated in FIG. 9 having a closure end 72 in accordance with the invention and an open end 74 ready for filling. In practice, the bag can be filled with any desired material, and end 74 can be closed using any conventional means such as a sewn strip 76 (see FIG. 1), or for that matter a closure in accordance with the invention can be employed at this remaining end.

Referring now to FIGS. 10–13, another embodiment of the invention is illustrated. In this embodiment, a bag-forming container 78 is provided which in all respects is identical to the bag 10, save for the configuration of the closure end. In particular, the container 78 is designed to accommodate a filling valve. In detail, container 78 is provided with front and rear main panels 80, 82 respectively presenting inner and outer faces 84, 86 and 88, 90 and gusseted side panels 92, 94 interconnecting panels 80, 82. The side panels each include an elongated central crease or fold line 96, 98, and outwardly diverging sub-panels 100, 102, and 104, 106. The respective sub-panels each present opposed inner and outer faces, namely outer and inner faces 108, 110 for sub-panel 100; outer and inner faces 112, 114 for sub-panel 102; outer and inner faces 116, 118 for sub-panel 104; and outer and inner faces 120, 122 for sub-panel 106.

Figure 10:
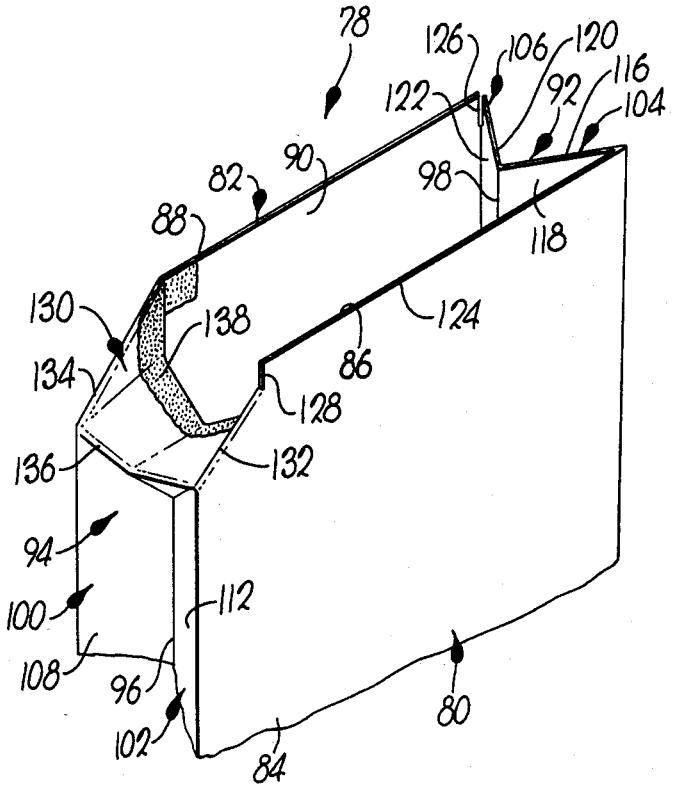
FIG. 10 is a perspective view of another embodiment in accordance with the invention in which a valving fold is made in one corner of the tube and glue is applied along a portion thereof.

The container 78 is flush cut at the upper end thereof as best seen in FIG. 10, to present a continuous uppermost marginal edge 124. The upper or closure end of the container 78 is provided with a pair of cuts 126, 128. These cuts are laterally spaced apart as viewed in FIG. 10, with cut 126 being provided at the juncture between rear panel 82 and sub-panel 106 of side panel 92. Cut 128 on the other hand is provided in front panel 80 and is spaced inwardly from the side margin of panel 80.

In bag-forming operations with container 78, a valve-receiving area 130 is formed by inward folding of the top portion of gusseted side panel 94 and adjacent portions of the panels 80, 82. Thus, front panel 80 is folded along an oblique fold line 132 extending from the bottom of cut 128 to the joinder of front panel 80 with side panel 94; likewise rear panel 82 is folded along an oblique fold line 134 extending from the upper margin of the rear panel to the gusseted panel 94. The panel 94 is folded along a substantially transversely extending fold line 136 between the lowermost ends of the oblique fold lines 132, 134. Accordingly, the substantially triangular portions of the panels 80, 82 above the respective fold lines 132, 134 and the substantially rectangular portions of the sub-panels 100, 102 above fold line 136, are folded inwardly between the confines of the opposed panels 80, 82. The wall portions forming the valve-receiving region may be adhesively secured to the inner faces 86, 90 of the panels 80, 82 if desired.

The next step in closing the upper end of container 78 to provide a filling valve involves applying glue as at 138 to the inboard margin of the walls defining area 130, whereupon an elongated, folded web member 140 is placed within area 130 and adhesively secured to the glue 138. Referring specifically to FIG. 11, it will be seen that web member 140 is folded along the length thereof and presents a pair of juxtaposed leaves 142, 144. Leaf 142 presents an uppermost marginal edge 146, whereas leaf 144 presents a similar edge 148; further, the vertical height of leaf 144 is greater than that of leaf 142, by an amount substantially equal to the depth of cut 128, so that edge 148 is substantially coincident with the uppermost margins of the panels 80, 82.

The next step in the closing operation involves applying glue as at 150 along the inner face of leaf 144 above edge 146, and along the upper margin of face 84, for a vertical distance substantially equal to the depth of cut 128.

Next, the glued margin of panel 80 is folded downwardly so as to engage a region 152 below the glue line 150. By virtue of the fact that cut 126 is provided at the juncture between panel 82 and side sub-panel 106, this first folding operation also serves to fold downwardly the upper margin of side panel 92 and thus expose a portion 122*a* of inner face 122 of sub-panel 106. The fold line 154 resulting from this first folding operation is substantially along the lower margin of glue line 150 extending transversely along front panel 80. Moreover, the first folding operation in effect defines and creates a first flap 156 comprising the portion of panel 80 between cut 128 and the juncture with side panel 92, and the upper marginal portion of side panel 92 extending from connection thereof to panel 80 to cut 126. The vertical margins of the flap 156 are, respectively, fold line 154, and the original uppermost margin of panel 80, edge 124.

An additional glue line 158 is next applied along the entire exposed surface of flap 156 (i.e., marginal portions of the original inner face 86 of panel 80, and inner face 122 of panel 92). This glue line is furthermore extended along the upper margin of leaf 142 as best seen in FIG. 12. Finally, a glue line 160 is applied along the entire length of the exposed upper margin of face 90 of rear panel 82, and along the portion of leaf 144 above edge 146 and fold line 154. During the second folding operation, a second flap 164 is folded downwardly as viewed in FIGS. 12–13, with the effect that first flap 156 and the glued portion of leaf 142 as folded into engagement with a region 166 immediately below glue line 158. Additionally, the glued portion of panel 82 above fold line 154, and the portion of leaf 144 above edge 146, respectively engage and are adhered to a region 168 below region 166. The second flap 164 thus includes the upper marginal portion of rear panel 82 above fold line 154, and the adjacent portion of leaf 144 above edge 146. This has the effect of closing the container 78 and also the upper open end of the web member 140 to create a completed valve bag 170 (FIG. 13). As those skilled in the art will readily appreciate, the web member 140, when folded and glued as aforesaid, creates tubular filling valve 172 which communicates with the interior of bag 170.

Referring now to FIGS. 14–17, another embodiment in accordance with the invention is illustrated. In this case, a bag-forming container 174 is provided which is identical in every respect with container 10, save for the fact that the innermost ply 176 of the container is formed of an appropriate synthetic resin material, whereas the remaining outer plies, including outermost ply 178, are formed of paper material. It will readily be understood that forming cuts of the type described in connection with container 10 in container 174 will result in a situation where glue is applied to the synthetic resin inner ply. This is troublesome, inasmuch as conventional glue used in the bag industry does not readily adhere to synthetic resin materials. In order to overcome this difficulty, while nevertheless providing a closure in accordance with the invention, the container 174 is provided with a pair of laterally spaced marginal flap-defining cuts 180, 182 between the outer paper plies of the rear panel as viewed in FIG. 14. In the particular embodiment illustrated in FIG. 14, the cuts 180, 182 are made between the outermost ply 178 and the next adjacent inboard paper ply.

The closure operation of container 174 proceeds in the exact manner described in connection with container 10. The only difference in this respect is that the first flap formed from the first folding operation comprises the upper margin of the front panel, side panels, and the inner plies of the rear panel. The configuration of the container after this first folding operation is illustrated in FIG. 17. The second folding operation merely involves folding outer ply 178 of the rear panel forwardly as viewed in FIG. 17, while simultaneously refolding the first flap, so as to complete the closure. It will furthermore be perceived that all of the glue connections in the closure, i.e., that of the first flap to the outer face of the front panel in two locations, and that of the outermost ply 178 to the outer face of the front panel, are all paper-to-paper. Nevertheless, the completed bag includes a desirable synthetic resin inner liner.

It has been found that a closure in accordance with the invention gives enhanced strength and burst resistant characteristics to the resultant bag, particularly as compared with prior double fold constructions. For example, and referring to FIG. 2, a double fold closure 184 is depicted of the type illustrated in U.S. Pat. No. 2,316,385. Specifically, in this type of double fold closure, the front and rear panels of a container tube are simply grasped and folded twice with intermediate gluing; no flap-forming cuts of the type herein described are employed. When a bag employing closure 184 is filled and dropped onto a surface as illustrated in FIG. 2, considerable force is concentrated along the innermost glue line of the closure. This tends to separate the innermost glued connection of the closure, with the result that the integrity of the enclosure is materially impaired.

In contrast to the foregoing, a closure 186 in accordance with the present invention (see FIG. 3) gives enhanced resistance to breakage. When a bag using closure 186 is filled and dropped onto a surface, the relatively wide glue lines employed, as well as the overlapping nature of the second flap, distribute the potentially destructive forces over a much greater area, to thus prevent breakage.

We claim:

1. A bag comprising:

a pair of facially opposed first and second panels each presenting an inner and an outer face;

side margin closure means for interconnecting said panels with the inner faces thereof in opposed adjacency and presenting, with said panels, at least a pair of elongated side marginal juncture lines;

end closure means for permanently closing at least one end of said bag, said end closure means including a first, elongated, marginal, transversely extending flap secured to said first panel adjacent said one end and presenting an outer face and an inner face, said first flap extending between and being defined at its lateral ends by a pair of spaced apart cut lines, at least one of said cut lines being located substantially at and along a portion of the length of one of said juncture lines, said first flap being double folded upon said first panel such that the outer face of the first flap engages said outer face of the first panel at a first region of said first panel, and said inner face of said first flap engages said outer face of the first panel at a second region adjacent said first region;

a second, marginal, transversely extending flap secured to said second panel and presenting an outer face and an inner face, said second flap extending laterally from and being defined at one of its lateral ends by said one cut line;

said second flap being folded over said first flap, with at least a portion of the inner face of the second flap being in engagement with said outer face of said first panel at a third region adjacent said second region; and means for adhesively and permanently securing said second flap inner face to said third region.

2. The bag as set forth in claim 1, each of said cut lines being located substantially at and along a portion of the length of a corresponding juncture line.

3. The bag as set forth in claim 1, said side margin closure means comprising respective gusset panels each including a pair of interconnected subpanels, said subpanels being secured to said first and second panels.

4. The bag as set forth in claim 3, each of said cut lines being located substantially at and along the length of a portion of a corresponding juncture line between said second panel and the adjacent subpanels of said gusset panels, said first flap including marginal, transversely extending portions of said first panel and said gusset panels, said second flap extending between and being defined at its lateral ends by said cut lines and comprising the transversely extending margin of said second panel.

5. The bag as set forth in claim 3, said end closure means including a valve element and presenting a valved side margin and a closed side margin, one of said cut lines being provided substantially at and along a portion of the length of the juncture line presented between said second panel and the adjacent subpanel of the gusset panel at said closed side margin, the other of said cut lines being located in said first panel and between the juncture lines defined by said first panel and the adjacent subpanels of said gusset panels, said one flap including laterally extending, marginal portions of said first panel extending from said second cut line to the closed side margin juncture line between the first panel and the adjacent gusset subpanel, and of the closed side margin gusset panel.

6. The bag as set forth in claim 1, said first and second panels each being formed of a plurality of facially opposed plies, said cut lines being provided through only certain of said plies including the outermost ply while leaving at least one ply uncut.

7. The bag as set forth in claim 1, said first and second panels, and said side margin closure means, being formed to present a substantially flush closure end.

8. A bag-forming tubular container, comprising:

a tubular body having— a pair of elongated, opposed, flexible first and second panels each formed of a plurality of facially opposed plies and presenting a transverse upper terminal edge, a transverse lower terminal edge and spaced side margins extending between said upper and lower edges;

a pair of gusset panels respectively interconnected to opposed adjacent side margins of said first and second panels, each of said gusset panels having an upper terminal edge and a lower terminal edge, said gusset panels, and said first and second panels, cooperatively presenting a plurality of elongated juncture lines, said upper terminal edges of said first, second and gusset panels cooperatively defining a substantially continuous, flush closure end; and a pair of relatively short, laterally spaced cuts in said body extending from said closure end, said cuts being provided through only certain of said plies including the outermost ply while leaving at least one ply uncut, said cuts extending generally along the length of said panels for dividing said closure end into first and second foldable flap portions respectively including portions of said first and second panels.

9. The container as set forth in claim 8, each of said cuts being located substantially at and along the length of a juncture line, said first and second flap portions respectively including substantially all of the marginal portions of said first and second panels.

10. The container as set forth in claim 8, one of said cuts being located substantially at and along a portion of the length of a juncture line defined between said second panel and one of said gusset panels, the other of said cuts being located in said first panel and spaced from the other of said gusset panels, said first flap portion extending between and being defined at its lateral ends by said cut lines, said second flap portion extending laterally from said one cut and including portions of said second panel.

11. A method of forming a bag comprising the steps of:

providing a bag-forming tube having first and second, facially opposed panels each having an outer face and an inner face, and side margin closure means for interconnectiong said panels and presenting, with the panels, at least a pair of elongated side marginal juncture lines; and permanently closing one end of said tube to form said bag, by— cutting said tube adjacent one end and along the length thereof and at laterally spaced locations thereon to define therebetween an elongated, marginal, transversely extending first flap secured to said first panel and having an outer face and an inner face, at least one of said cuts being located substantially at and along a portion of the length of one of said juncture lines, said first flap being defined at its lateral ends by said cut lines;

folding said first flap upon said outer face of said first panel, and securing said first flap outer face to said outer face of the first panel at a first region thereon;

additionally folding said first flap upon said first panel until said inner face of said first flap engages said outer face of the first panel at a second region thereon adjacent said first region, and folding a second flap secured to said second panel over said first flap until a portion of the second flap overlies said first flap and extends beyond the first flap and engages said first panel outer face at a third region, and securing said second flap to said third region, said second flap extending laterally from and being defined at one of its lateral ends by said one cut line.

12. The method described in claim 11, wherein said side margin closure means comprises respective, marginal, gusseted side panels interconnecting said first and second panels, said cutting step comprising cutting the tube substantially at the joinder of said second panel and said gusseted side panels.

13. The method described in claim 11, wherein said bag-forming tube has a plurality of plies of flexible sheet material, said cutting step comprising cutting the tube through only certain of said plies including the outermost ply while leaving at least one ply uncut.

14. The method described in claim 11, comprising the additional steps of:

cutting said tube end to locate said one cut substantially at the juncture of said second panel and one of said side margin closure means, and to locate the other of said cuts in said first panel and between the side margins thereof; and after said cutting step, inserting valve means between said first and second panels adjacent said other cut, said valve means being a length to extend outwardly from said tube for communicating the interior thereof with the atmosphere.

* * * * *